United States Patent [19]

Schleicher et al.

[11] 4,306,175

[45] Dec. 15, 1981

[54] INDUCTION PLASMA SYSTEM

[75] Inventors: Robert G. Schleicher, Winchester; Stanley B. Smith, Jr., Westford; George A. McLean, Chelmsford, all of Mass.

[73] Assignee: Instrumentation Laboratory Inc., Lexington, Mass.

[21] Appl. No.: 125,999

[22] Filed: Feb. 29, 1980

[51] Int. Cl.[3] ..... H05H 1/30

[52] U.S. Cl. ..... 315/111.21; 313/231.31; 315/248; 315/111.51; 315/357; 356/316

[58] Field of Search ..... 315/111.2, 111.5, 248, 315/331, 332, 348, 357; 313/146, 147, 231.3; 356/316; 219/121 PM, 121 PR, 121 PW

[56] References Cited

U.S. PATENT DOCUMENTS

| | | | |
|---|---|---|---|
| 3,296,410 | 1/1967 | Hedger | 313/231 |
| 3,353,060 | 11/1967 | Yamamoto et al. | 315/111 |
| 3,401,302 | 9/1968 | Thorpe et al. | 315/111 |
| 3,501,675 | 3/1970 | Cleaver et al. | 315/111 |
| 3,530,334 | 9/1970 | Thorpe et al. | 315/111 |
| 3,569,777 | 3/1971 | Beaudry | 315/111.2 |
| 3,958,883 | 5/1976 | Turner | 356/316 |
| 4,002,944 | 1/1977 | McNeill et al. | 315/248 X |

OTHER PUBLICATIONS

Allemand et al., *Design of a Fixed-Frequency Impedance Matching Network, etc.*, Spectrochim Acta, vol. 33B, 1978, pp. 513-534.

*Primary Examiner*—Eugene R. LaRoche

[57] ABSTRACT

An induction plasma system includes a plasma chamber, a high frequency electrical coil that surrounds the chamber, and an oscillator for energizing the coil to establish a plasma maintaining condition in the chamber. The oscillator tank circuit includes the coil, and is tuned so that it is essentially at resonance when a plasma condition is established in the chamber. Ignition means is arranged for initiating a plasma condition, and is constructed such that insertion of the ignition means into the chamber in the absence of a plasma condition shifts the impedance condition in the chamber to essentially the same tuned condition that exists when a plasma condition is established in the plasma chamber, but without need to adjust any component of the tank circuit.

9 Claims, 5 Drawing Figures

INDUCTION PLASMA SYSTEM

This invention relates to induction plasma systems.

Such plasma systems create high temperature thermal plasma gas conditions by inductively coupling high frequency electrical energy to ionized gas and are useful for a variety of purposes, including the production of chemical reactions, testing and treatment of materials, general industrial heating, and as spectroscopic excitation sources. In such systems a plasma of annular form is produced by passing a gas stream along the axis of an induction coil of a high frequency power source. In a spectroscopic excitation source the sample to be analyzed is introduced into the plasma, and excited to spectroemissive levels such that characteristic radiations are emitted which are detected and measured.

In such systems the reflected impedance of the induction coil changes significantly between the unionized condition (before plasma ignition) and the ionized condition (after plasma ignition). Conventionally induction plasma power supply systems have a retuning capability to accommodate this change in impedance, a capability which has made the circuits more expensive to build and operate but which was necessary to protect the power supply circuit against excessive current flows which occur when improper impedance matching conditions are created.

In accordance with the invention, there is provided an induction plasma system that includes a plasma chamber, a high frequency electrical coil that surrounds the chamber, and an oscillator for energizing the coil to establish a plasma maintaining condition in the chamber. The oscillator tank circuit includes the coil, and is tuned so that it is essentially at resonance when a plasma condition is established in the chamber. Ignition means is arranged for initiating a plasma condition, and is constructed such that insertion of the ignition means into the chamber in the absence of a plasma condition shifts the impedance condition in the chamber to essentially the same tuned condition that exists when a plasma condition is established in the plasma chamber, but without need to adjust any component of the tank circuit. Thus, a plasma condition may be both initiated and maintained without any adjustment of any tank circuit component.

While the invention is useful with various types of induction plasma systems, it is particularly useful in a spectroanalysis system in which the plasma system is optically coupled to an analysis apparatus and a spectroscopic sample to be analyzed is introduced into the plasma and raised to spectroemissive levels by the plasma for analysis by the analysis system.

Preferably, the igniter is a dimensionally-shaped graphite element and is positioned within the electromagnetic field provided by the induction coil of the tank circuit so that it tunes the tank circuit to resonance and then it is inductively heated when the induction coil is energized to create an ion seeding filamentary type discharge which then converts the carrier gas to a plasma. A preferred igniter has the shape of a thin-walled tube, a design which provides both effective tuning of the resonant tank circuit and reliable plasma ignition. The thickness of the annular wall of the graphite tube affects both the resonant tuning and the temperature achievable with a given power input. Other dimensionally-shaped igniter elements also provide effective retuning of the resonant tank circuit and plasma ignition action including a graphite igniter that has a pointed end and which is inserted closely adjacent the most intense portion of the electric field. The igniter is shaped and positioned in the plasma chamber so that the reflected load is essentially (within about one picofarad capacitance) at resonance.

In a particular embodiment, the plasma chamber has an internal diameter of about three times the diameter of the tubular igniter tube, the work coil has two and one-half turns, and the oscillator is energized at a frequency of about twenty-seven megahertz. The plasma forming gas is supplied for spiral flow up into the plasma region of the plasma chamber and, after plasma has been ignited and the igniter withdrawn from the plasma chamber, the sample to be analyzed is flowed into the plasma region in nebulized form and excited to spectroemissive levels for analysis by the associated spectrometric system without any need to retune the RF power supply circuit.

Other features and advantages of the invention will be seen as the following description of particular embodiments progresses, in conjunction with the drawings in which.

DESCRIPTION OF PARTICULAR EMBODIMENTS

Figure 1:
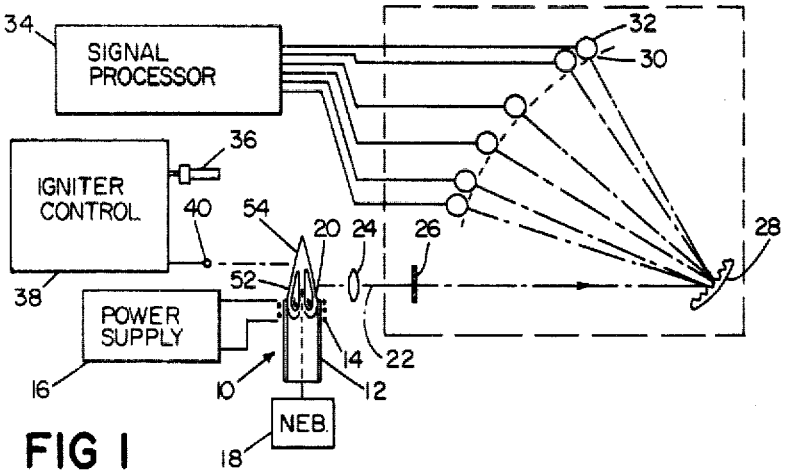
FIG. 1 is a diagrammatic view of an induction coupled plasma spectroscopic system incorporating the invention.

With reference to FIG. 1, there is shown a spectroscopic system having an inductively coupled plasma source 10 formed in tubular chamber 12 that is surrounded by induction coil 14 that is connected to power source 16. The sample to be analyzed is nebulized by nebulizer 18 and is flowed into the plasma region 20 by a carrier gas.

Radiation emitted by the excited specimen in plasma region 20 is directed along axis 22 through lens 24 and entrance slit 26 towards concave diffraction grating 28 to produce a spectrum, preselected line of which are imaged on exit slits 30. The selected spectral lines pass through exit slits 30 and are detected by photo detectors 32 which in association with signal processing and output circuits 34 provide an indication of the chemical composition of the sample being analyzed. Igniter 36 is moved into and out of plasma region 20 by control 38.

Figure 2:
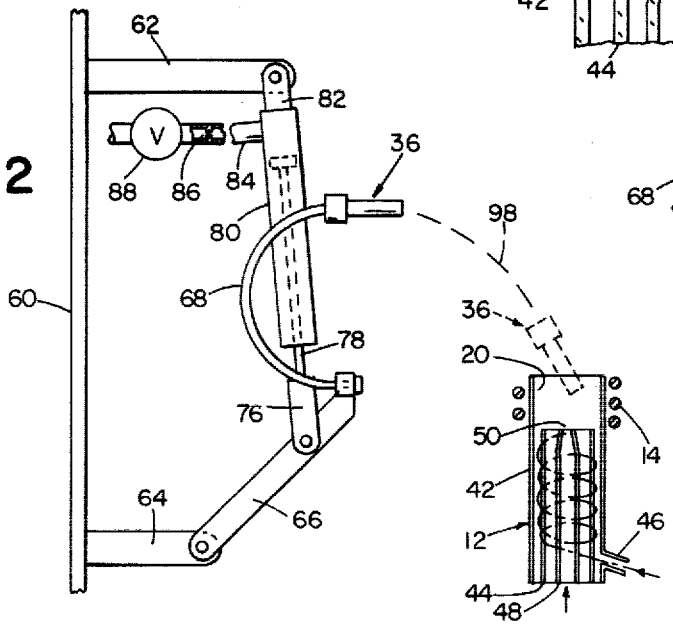
FIG. 2 is a diagrammatic view of the plasma chamber and igniter system.

Further details of the plasma source 10 may be seen with reference to FIG. 2. That plasma torch includes a quartz outer tube 42 having an internal diameter of about two centimeters. Within tube 42 is a second tube 44 that defines an annular axially extending channel to which is supplied plasma forming gas such as argon from inlet 46 for spiral flow up into the plasma region 20. A third coaxially arranged tube 48 has a taper that terminates in nozzle orifice 50 and receives a flow of carrier gas which transports the nebulized sample into plasma region 20. Surrounding the upper end of the plasma chamber is a water cooled 2½ turn induction coil 14 that has a diameter of about 2.5 centimeters and a height of about two centimeters and which is connected to power supply 16. The established plasma condition includes an ionized toroid 52 with a flame portion 54 extending upwardly above the end of chamber tube 42 across the detection axis 22, as indicated in FIG. 1.

Further details of the igniter control 38 may be seen with reference to FIG. 2. The control linkage for igniter 36 is mounted on an RF ground plate 60 from which extend upper support 62 and lower support 64. Pivotably attached to lower support 64 is lever arm 66 to which a ⅛ inch diameter arcuate rod 68 is fixedly attached. Carbon igniter 36 is threadedly attached to rod 68. Secured to lever arm 66 by coupling 76 is piston rod 78 of air cylinder 80. The upper end of cylinder 80 is pivotably connected to support 62 by link 82. Disposed in air inlet 84 is a flow control orifice 86 and air supplied through line 84 as controlled by valve 88 drives piston 78 downwardly, rotating lever arm 66 downwardly and moving igniter 36 along dashed line path 90 to insert the igniter into plasma chamber 20 in the position shown in FIG. 3.

Igniter 36 has a coupling end 90 in which is formed a socket 92 which threadedly receives the end of support rod 68. Extending from coupling portion 90 is a tubular igniter portion 94 about 2½ centimeters in length and about 0.7 centimeter in diameter. A bore 96 extends axially into the igniter portion 94 such that the igniter portion has a tubular wall of about one millimeter thickness.

Figure 3:
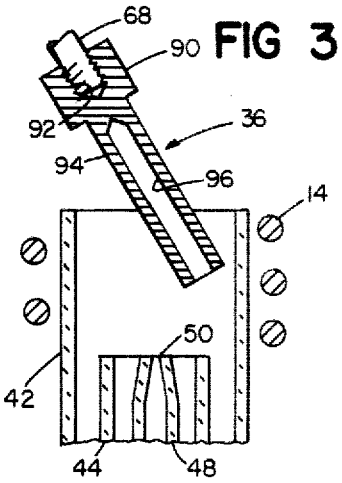
FIG. 3 is a view, similar to FIG. 2, showing the igniter in ignition position in the plasma chamber.

Insertion of igniter 36 into plasma chamber 20 in the position shown in FIG. 3 (without any ionization in region 20) shifts the effective reflected impedance of the induction coil 14 to essentially the same reflected impedance provided by an established plasma condition at the normal power operating level at the design frequency of 27.12 megahertz. Thus, substantially the same load matching condition is provided for both preignition (igniter 36 in chamber 20 without plasma) and postignition (plasma in chamber 20 without igniter 36) conditions without adjusting of any inductance or capacitance component of the tank circuit.

Figure 4:
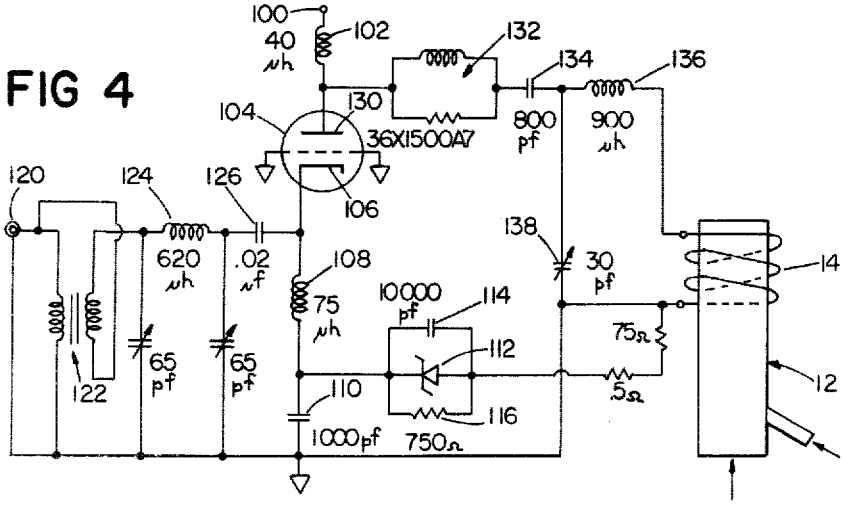
FIG. 4 is a detailed schematic diagram of the RF power supply circuitry employed in the system of FIG. 1.

Details of the RF oscillator power supply circuit 16 may be seen with reference to FIG. 4. Connected to DC power supply terminal 100 is RF choke 102. The grounded grid power supply tube 104 has its cathode 106 connected via choke 108 and capacitor 110 to ground. A cathode biasing circuit of Zener diode 112, capacitor 114, and resistor 116 biases the cathode more positive than the grid. The 27.12 megahertz drive signal is applied at terminal 120 through impedance matching transformer 122, filter 124 and coupling capacitor 126 to cathode 106. The anode 130 of tube 104 is connected through tuning circuit 132 and coupling capacitor 134 to a tank circuit that includes work coil 14, inductor 136, and capacitor 138. (Capacitor 138 is adjustable but is used only to initially tune the tank circuit to the 27.12 megahertz resonance as compensation for the physical shape of the work coil 14).

In operation, igniter 36 is inserted into plasma chamber 20 by operation of air cylinder 80 to the position shown in FIG. 3; nebulizer 18 is turned on and primary coolant and RF power are applied at a preheat level for ten seconds (approximately 350 watts in work coil 14). The nebulizer is then turned off and after a delay of ten seconds, the RF power is increased to ignition level (about 1000 watts in work coil 14). Induced current flow in igniter 94 heats that igniter and initiates a filamentary discharge which converts the plasma gas introduced through inlet 46 to plasma condition. The plasma condition should be established promptly and is detected by photo detector 40 which operates solenoid air valve 88 to cause air cylinder 80 to withdraw igniter 36 from plasma chamber 20. The load circuit returns to resonance and power supply control is transferred to automatic gain control to maintain the established plasma condition.

Figure 5:
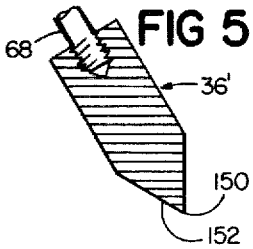
FIG. 5 is a view of an alternate form of igniter in accordance with the invention.

An alternate form of igniter is shown in FIG. 5. That igniter 36' is a graphite rod which has a length of about 2½ centimeters, a diameter of about one centimeter, and a tip 150 defined by conical end surface 152 that has an included angle of 60 degrees.

While particular embodiments of the invention have been shown and described, various modifications will be apparent to those skilled in the art and therefore it is not intended that the invention be limited to the disclosed embodiment or to details thereof, and departures may be made therefrom within the spirit and scope of the invention.

What is claimed is:

1. An induction plasma system comprising means defining a plasma chamber, a high frequency electrical coil surrounding said chamber, an oscillator for energizing said coil to establish a plasma maintaining condition in said chamber, said oscillator including a tank circuit tuned essentially to resonance with a plasma condition in said chamber, means for flowing gas through said chamber, and ignition means for disposition in said chamber to initiate a plasma condition, said ignition means being constructed such that insertion of said ignition means into said chamber in the absence of a plasma condition shifts the impedance condition in said chamber to essentially the resonance condition that is established with said plasma condition without retuning said tank circuit.

2. The system of claim 1 wherein said ignition means includes a dimensionally-shaped graphite igniter element.

3. The system of claim 2 wherein said igniter element has a tubular portion that is inserted into said plasma chamber.

4. The system of claim 2 wherein said igniter element has a conical tip that is inserted into said plasma chamber.

5. The system of claim 1 and further including an igniter insertion mechanism for inserting said igniter into said plasma chamber.

6. The system of either claim 1 or 5 and further including plasma sensor means, and means responsive to said plasma sensor means for withdrawing said igniter element from said plasma chamber upon establishment of a plasma condition in said chamber.

7. The system of claim 1 and further including a spectroanalysis system optically coupled to said plasma system, and means for introducing a spectroscopic sample to be analyzed into said plasma to raise said sample to spectroemissive levels for analysis by said spectroanalysis system.

8. The system of claim 7 wherein said sample introducing means includes a nebulizer.

9. The system of any one of claims 1, 2, or 7 wherein said tank circuit includes said coil and a capacitor.

* * * * *